US005955398A

United States Patent [19]

Fisher et al.

[11] Patent Number: 5,955,398

[45] Date of Patent: Sep. 21, 1999

[54] THERMALLY-RESPONSIVE RECORD MATERIAL

[75] Inventors: Mark Robert Fisher, Appleton; John Charles DeBraal, Kimberly; Joseph Peter Gusse, Appleton, all of Wis.

[73] Assignee: Appleton Papers Inc., Appleton, Wis.

[21] Appl. No.: 08/842,965

[22] Filed: Apr. 25, 1997

[51] Int. Cl.[6] ..... B41M 5/30

[52] U.S. Cl. ..... 503/209; 427/151; 503/208; 503/216; 503/217; 503/221

[58] Field of Search ..... 427/150–152; 503/208, 209, 216, 217, 221

[56] References Cited

U.S. PATENT DOCUMENTS

| | | | |
|---|---|---|---|
| Re. 33,815 | 2/1992 | Yamaguchi et al. | 503/214 |
| 4,400,437 | 8/1983 | Oeda | 428/447 |
| 4,510,513 | 4/1985 | Yamaguchi et al. | 346/214 |
| 4,531,140 | 7/1985 | Suzuki et al. | 346/209 |
| 4,544,936 | 10/1985 | Yokoi | 346/209 |
| 4,659,643 | 4/1987 | Ishida et al. | 430/157 |
| 4,742,042 | 5/1988 | Hiraishi et al. | 503/201 |
| 4,808,566 | 2/1989 | Takashima et al. | 503/217 |
| 4,855,278 | 8/1989 | Igarashi et al. | 503/208 |
| 4,874,740 | 10/1989 | Hiraishi et al. | 503/201 |
| 4,999,332 | 3/1991 | Okumura et al. | 503/209 |
| 5,420,094 | 5/1995 | Araki et al. | 503/216 |

FOREIGN PATENT DOCUMENTS

| | | | |
|---|---|---|---|
| 0048026 A1 | 3/1982 | European Pat. Off. | 503/221 |
| 60-202155 | 10/1985 | Japan | 503/221 |
| 1269601 | 4/1972 | United Kingdom | 503/221 |

*Primary Examiner*—Bruce H. Hess
*Attorney, Agent, or Firm*—Benjamin Mieliulis

[57] ABSTRACT

An improved thermally-responsive record material useful for bar coding is disclosed comprising a support having provided thereon in substantially contiguous relationship: a substantially colorless dye precursor comprising 2-anilino-3-methyl-6-dibutylaminofluoran; a sensitizer selected from the group consisting of 1,2-diphenoxyethane and 1,2-(4-methylphenoxy)ethane; an acidic developer material comprising bis-(3-allyl-4-hydroxyphenyl)sulfone which upon being heated reacts with said dye precursor to develop color; and a binder material. The improved thermally-responsive record material and bar code of the invention has a high print contrast signal; high dimensional stability in terms of low bar width growth degradation; a high percentage of successful decodes; and high contrast of the bar code with the background. The invention overcomes difficulties in past efforts to bring together a confluence of these characteristics in one coating formulation.

16 Claims, 8 Drawing Sheets

THERMALLY-RESPONSIVE RECORD MATERIAL

BACKGROUND OF THE INVENTION

1. Field of the Invention

This invention relates to a thermally-responsive record material. It more particularly relates to such record material in the form of sheets coated with color-forming systems comprising chromogenic material (electron-donating dye precursors) and acidic color developer material. This invention particularly concerns a thermally-responsive record material capable of forming a substantially non-reversible image resistant to fade or erasure and useful for producing functional bar codes. The invention teaches an improved thermally-sensitive record material which when imaged with bar codes exhibit superior image properties cumulatively in terms of print contrast signal.

2. Description of the Related Art

Thermally-responsive record material systems are well known in the art and are described in many patents, for example. U.S. Pat. Nos. 3,539,375; 3,674,535; 3,746,675; 4,151,748; 4,181,771; 4,246,318; and 4,470,057 which are incorporated herein by reference. In these systems, basic colorless or lightly colored chromogenic material and acidic color developer material are contained in a coating on a substrate which, when heated to a suitable temperature, melts or softens to permit said materials to react, thereby producing a colored mark.

Thermally-responsive record materials have characteristic thermal response, desirably producing a colored image of sufficient intensity upon selective thermal exposure.

A drawback of thermally-responsive record material limiting utilization in certain environments and application has been the undesirable tendency of thermally-responsive record material upon forming an image to not retain that image in its original integrity over time when the thermally-responsive record material is handled or exposed to common liquids or oils or plasticizers such as found in skin oil, plastic food wrap, cooling oil and solvents such as common carbonless paper solvents.

Thermally-responsive record materials are increasingly utilized for bar code imaging, since such bar codes can be readily created by printer equipment in the field nearer the point of use and application.

Bar codes provide a convenient means for computerized inventory or goods handling and tracking. To function properly, it is necessary that the bar code have high print contrast signal, and that the thermally-responsive material on which the bar code is imaged resist unwanted bar width growth after imaging. The characters or bars must not only be intensely imaged, but must be sharp, and unbroken or free of pin holes. It is also necessary that when read by a scanner that a high percentage of scans result in successful decoding of the information in the bar code. The percentage of successful decodes of the bar code information must be maintained at a high value for the thermally-responsive record material to gain wide commercial acceptance for use in bar coding applications.

Print contrast signal relates to image intensity. Bar width growth relates to imaged bar dimensional stability and character sharpness. Percent decode relates to image integrity. Background contrast must also be maintained at a high level. Difficulties have been encountered attempting to bring together a confluence of these characteristics simultaneously in one coating formulation.

It is an object of the present invention to disclose an improved thermally-responsive record material having a high print contrast signal; high dimensional stability in terms of low bar width growth; a high percentage of successful decodes; and high contrast of the bar code with the background.

DETAILED DESCRIPTION OF THE PREFERRED EMBODIMENTS

Figure 1:
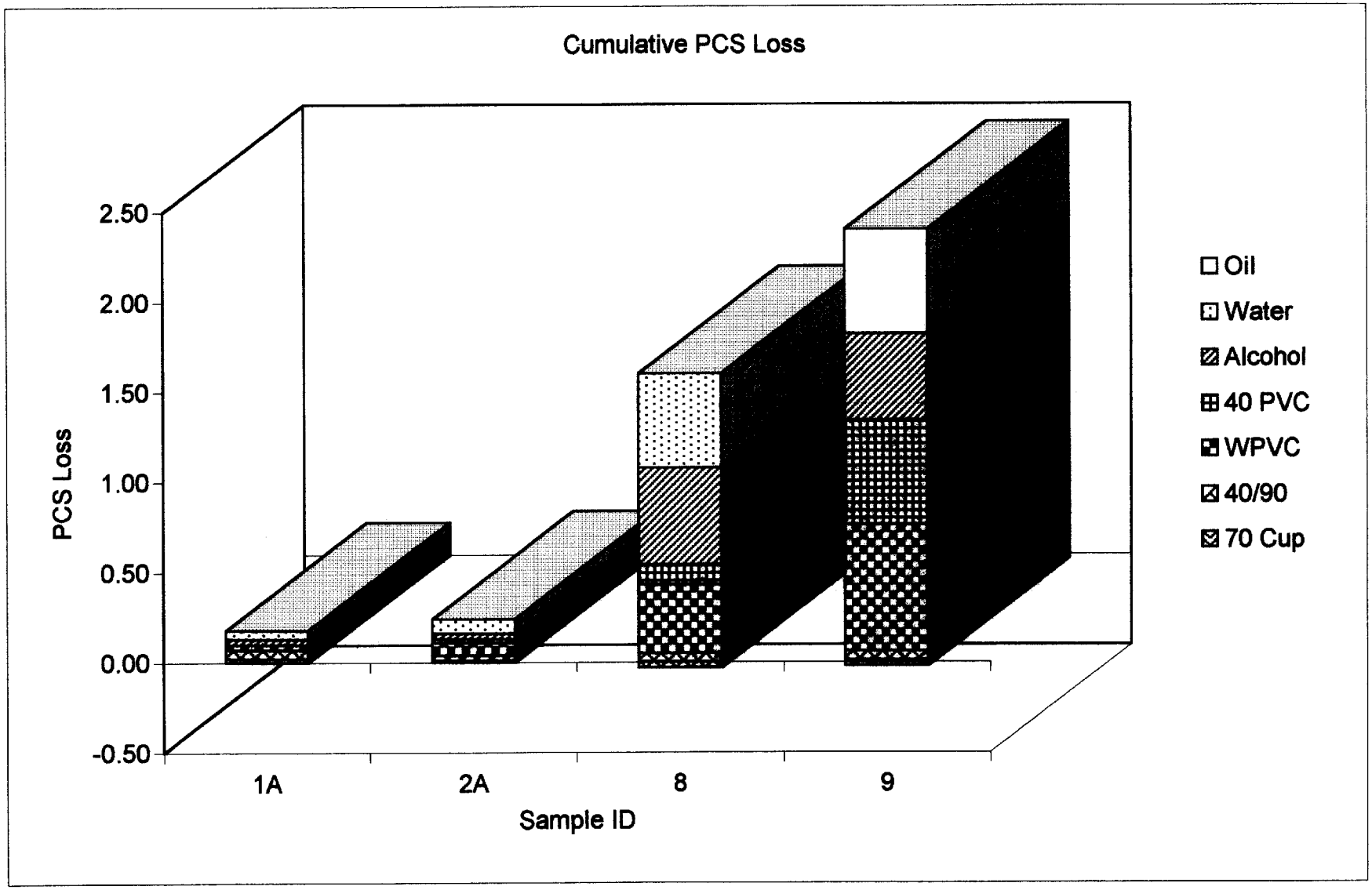
FIG. 1 is a bar graph representation for samples of print contrast signal values represented cumulatively for environmental challenge tests comprising oil, water, alcohol, 40° C. PVC, WPVC, 40/90% humidity and 70° cup humidity.
Figure 2:
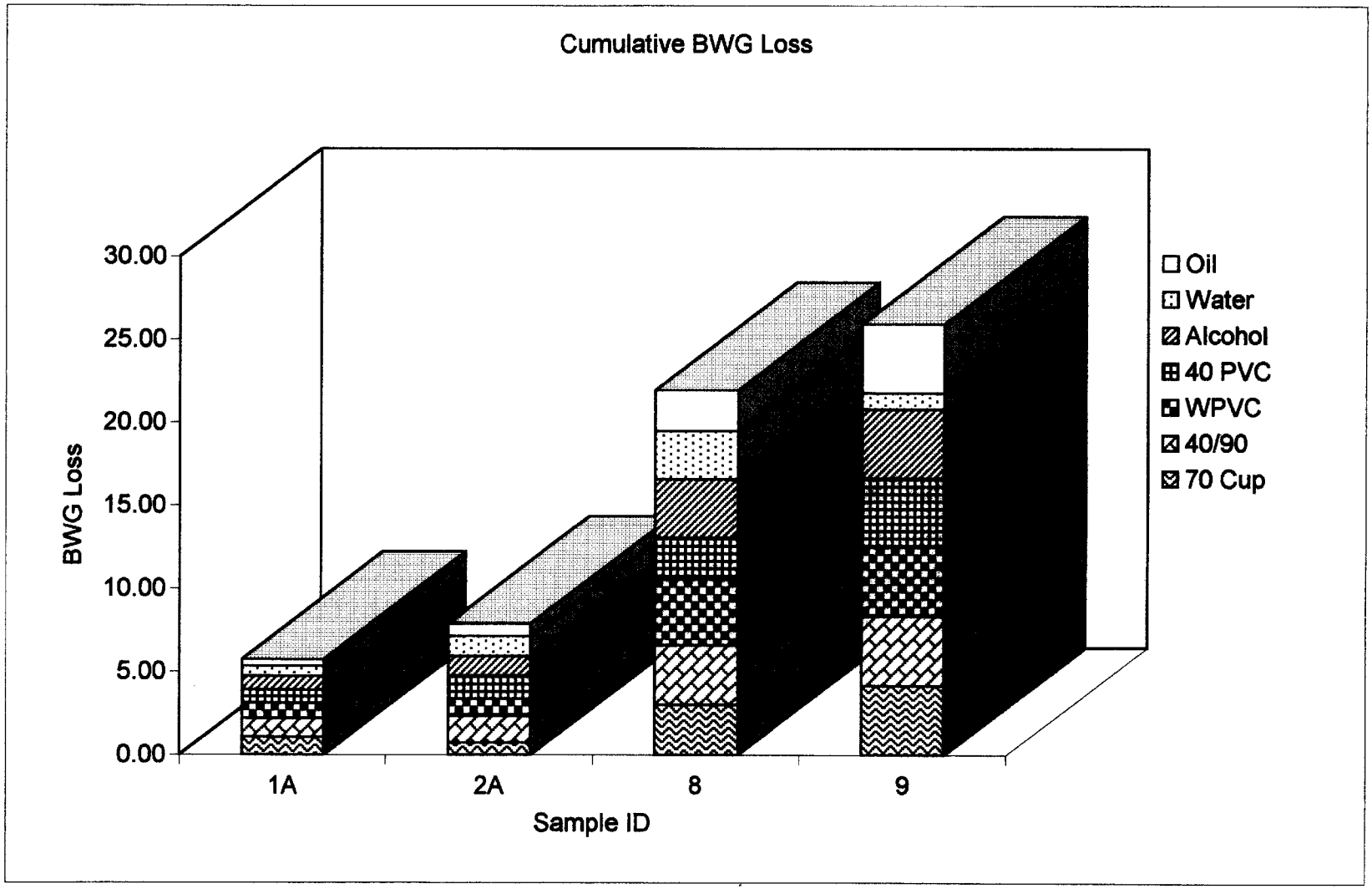
FIG. 2 is a bar graph representation of bar width growth of samples subjected to the environmental challenge tests recited above.
Figure 3:
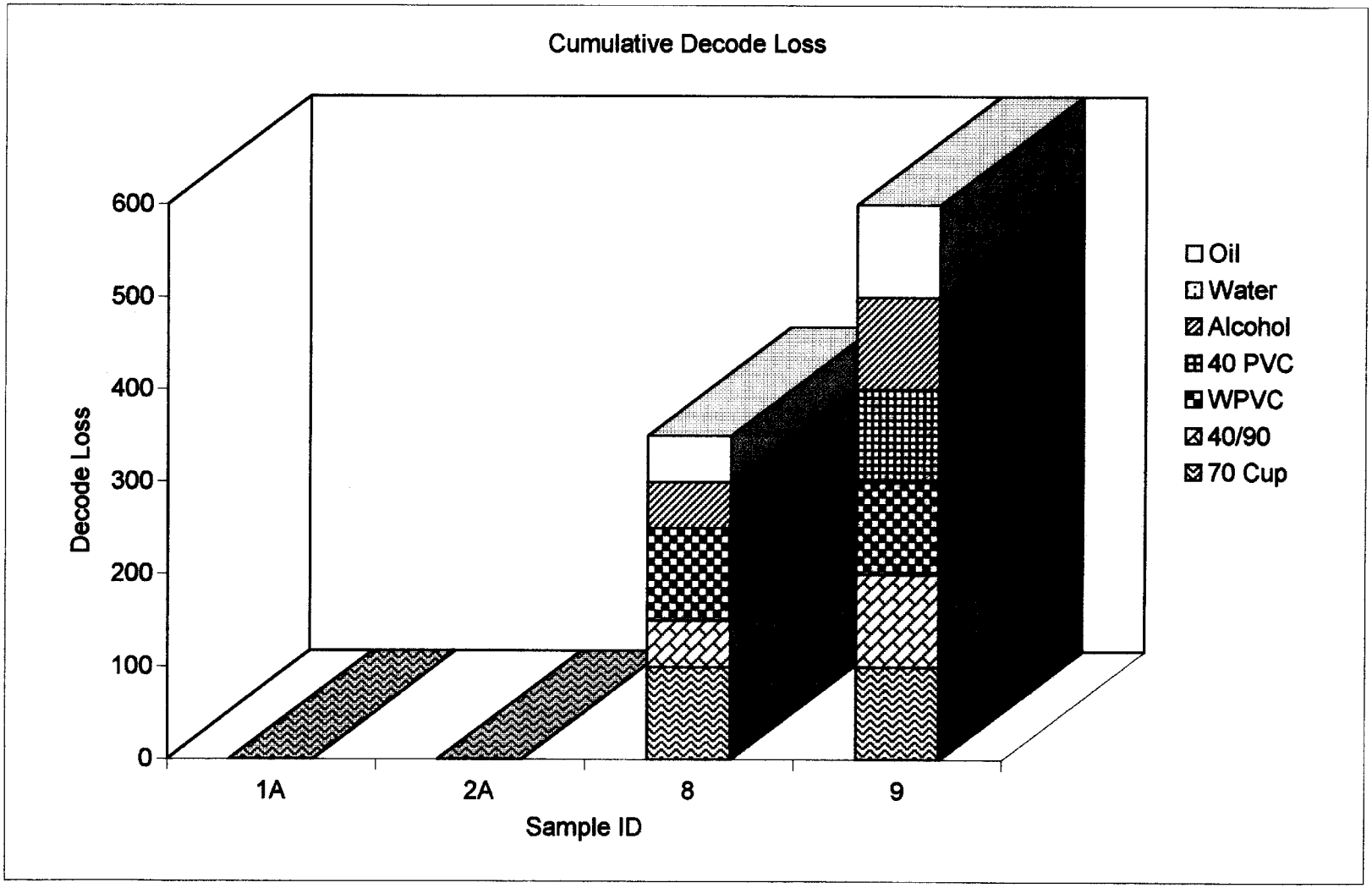
FIG. 3 is a bar graph representation of cumulative decode loss of samples subjected to the environmental challenges recited above.
Figure 4:
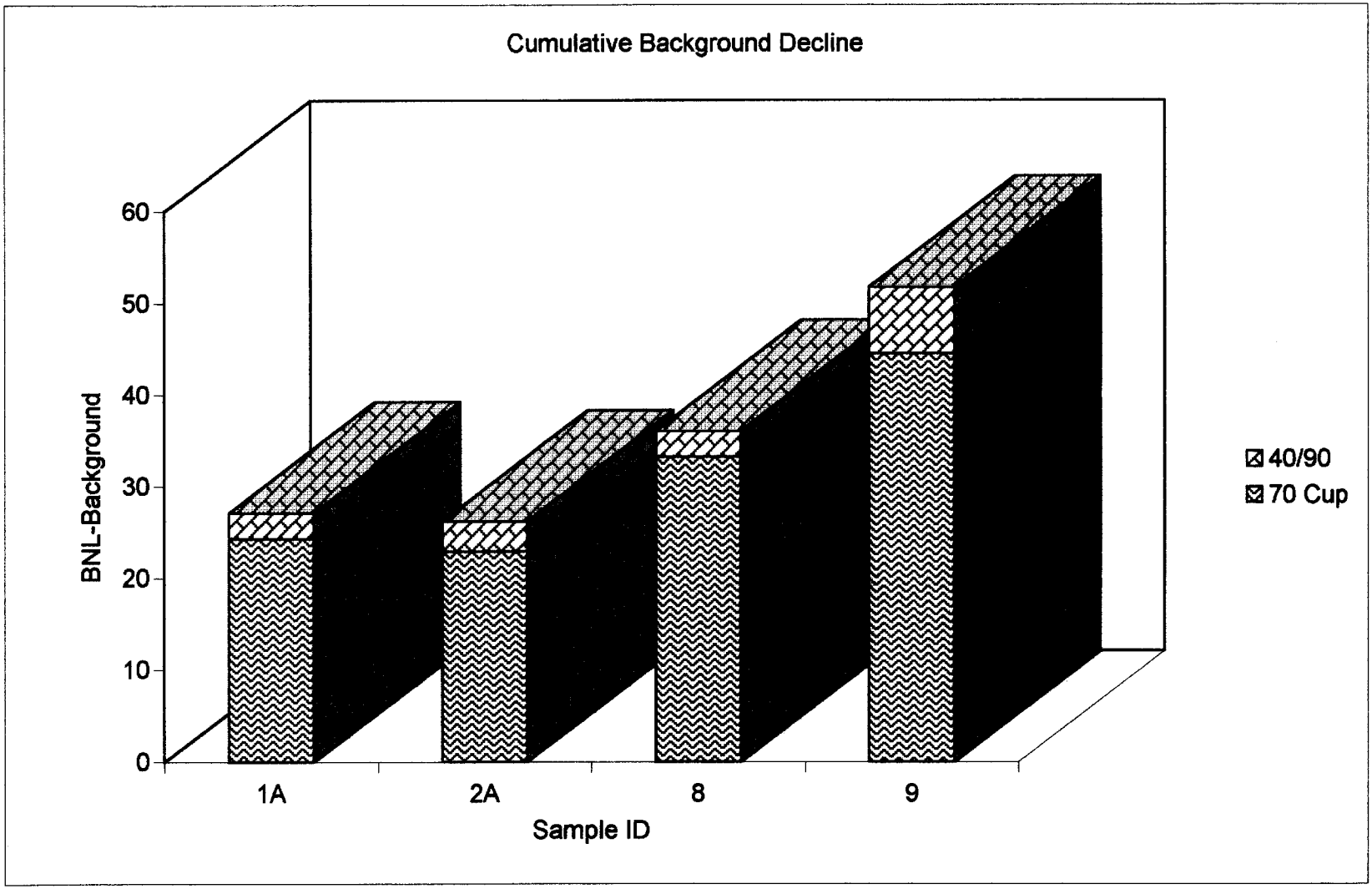
FIG. 4 is a bar graph representation of background decline values for samples subjected to relative humidity and 70° cup humidity challenges.
Figure 5:
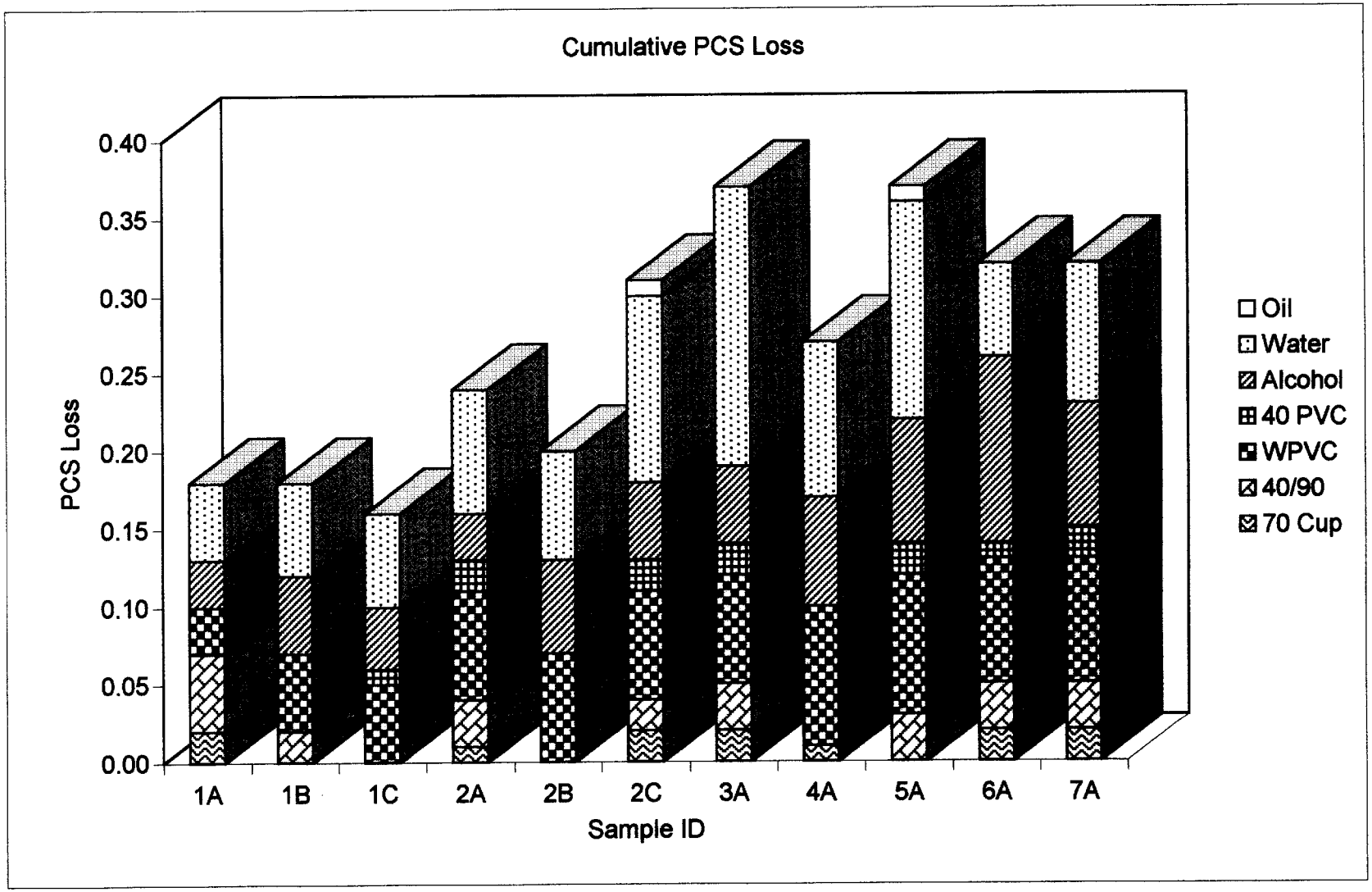
FIG. 5 is a bar graph representation for sample of print contrast signal values represented cumulatively for environmental challenge tests comprising oil, water, alcohol, 40° C. PVC, WPVC, 40/90% humidity, and 70° cup humidity.
Figure 6:
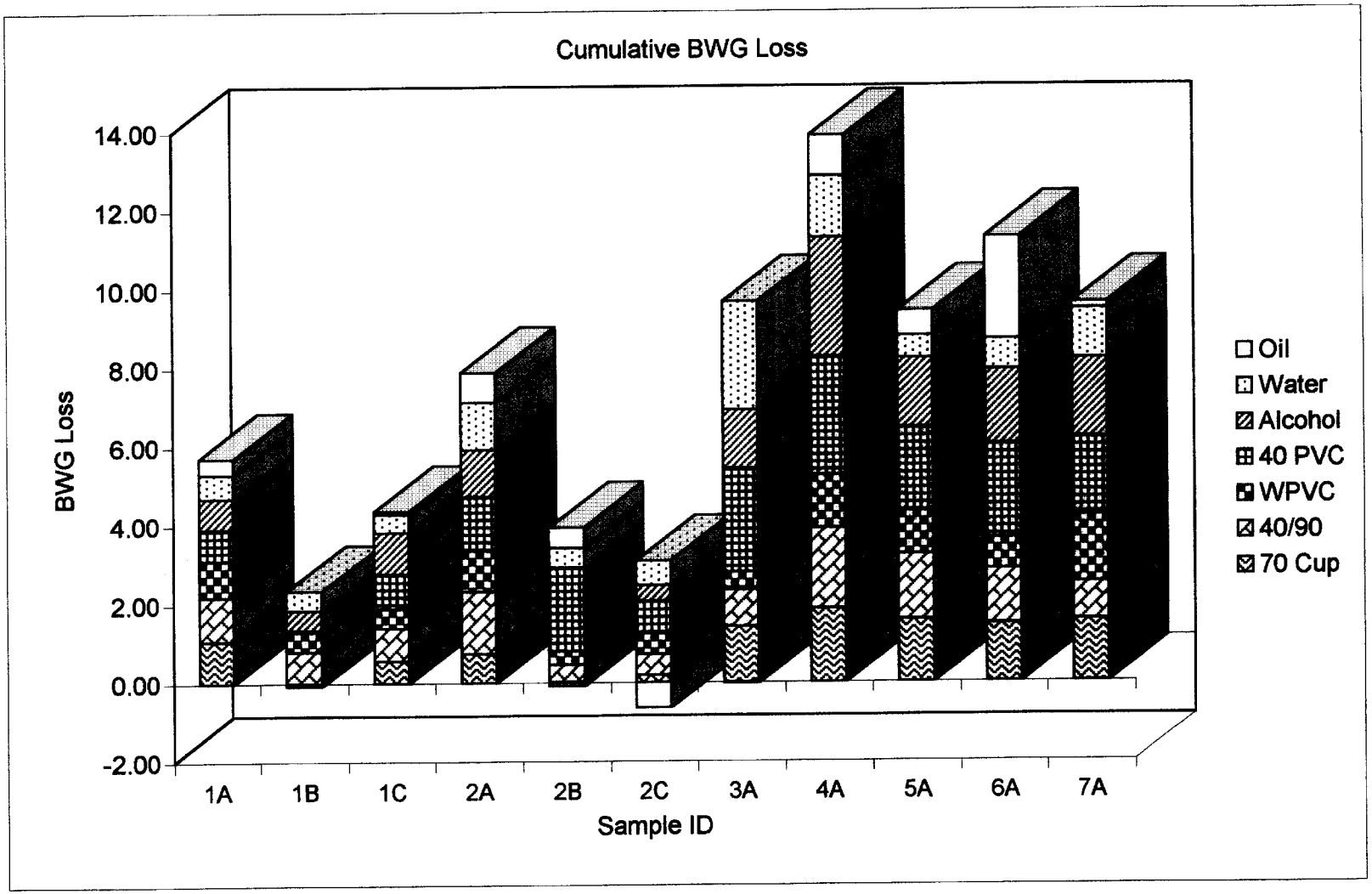
FIG. 6 is a bar graph representation of bar width growth values of samples subjected to the environmental challenges recited in FIG. 5.
Figure 7:
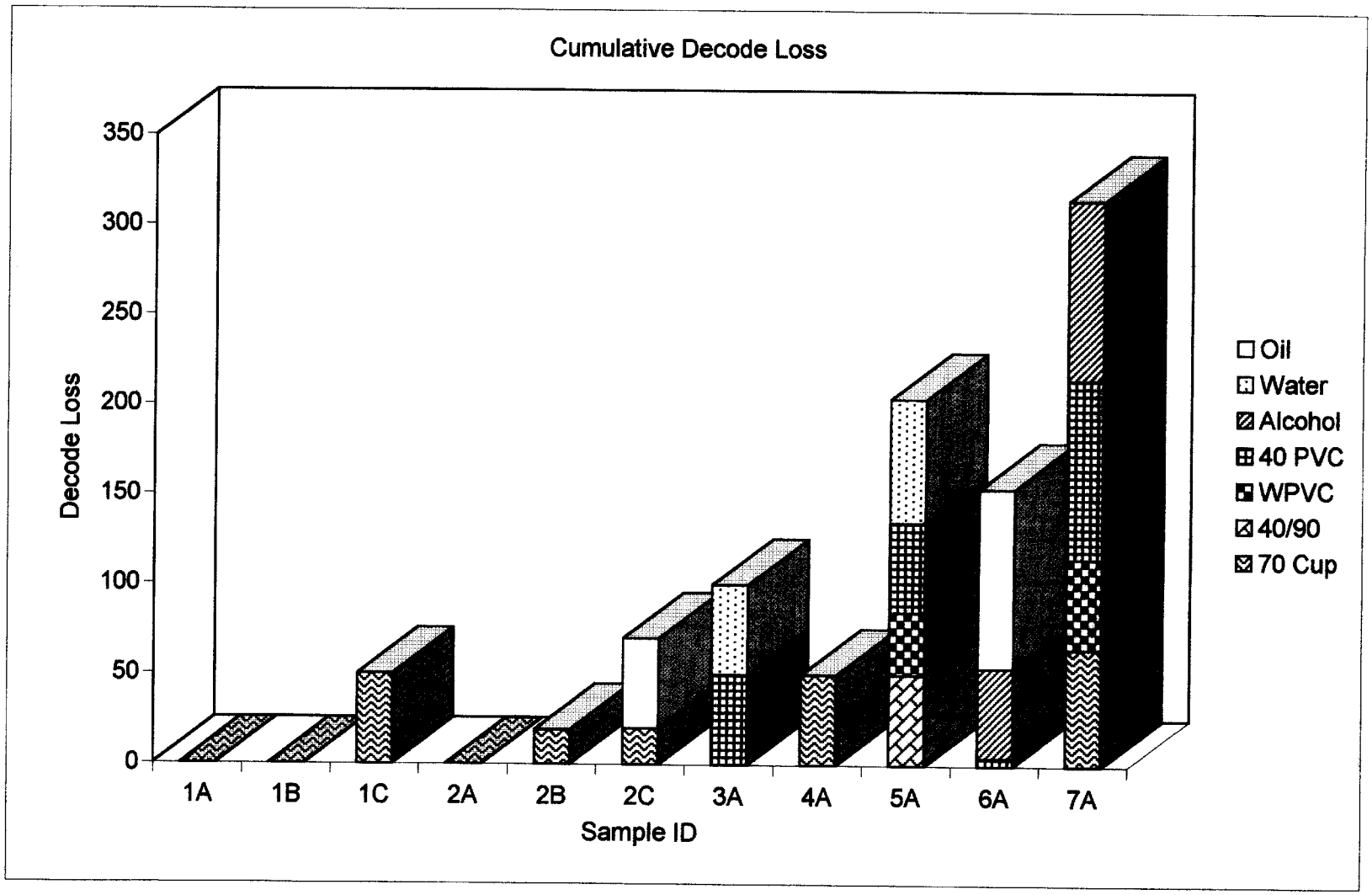
FIG. 7 is a bar code representation of cumulative decode loss of samples subjected to environmental challenges recited in FIG. 5.
Figure 8:
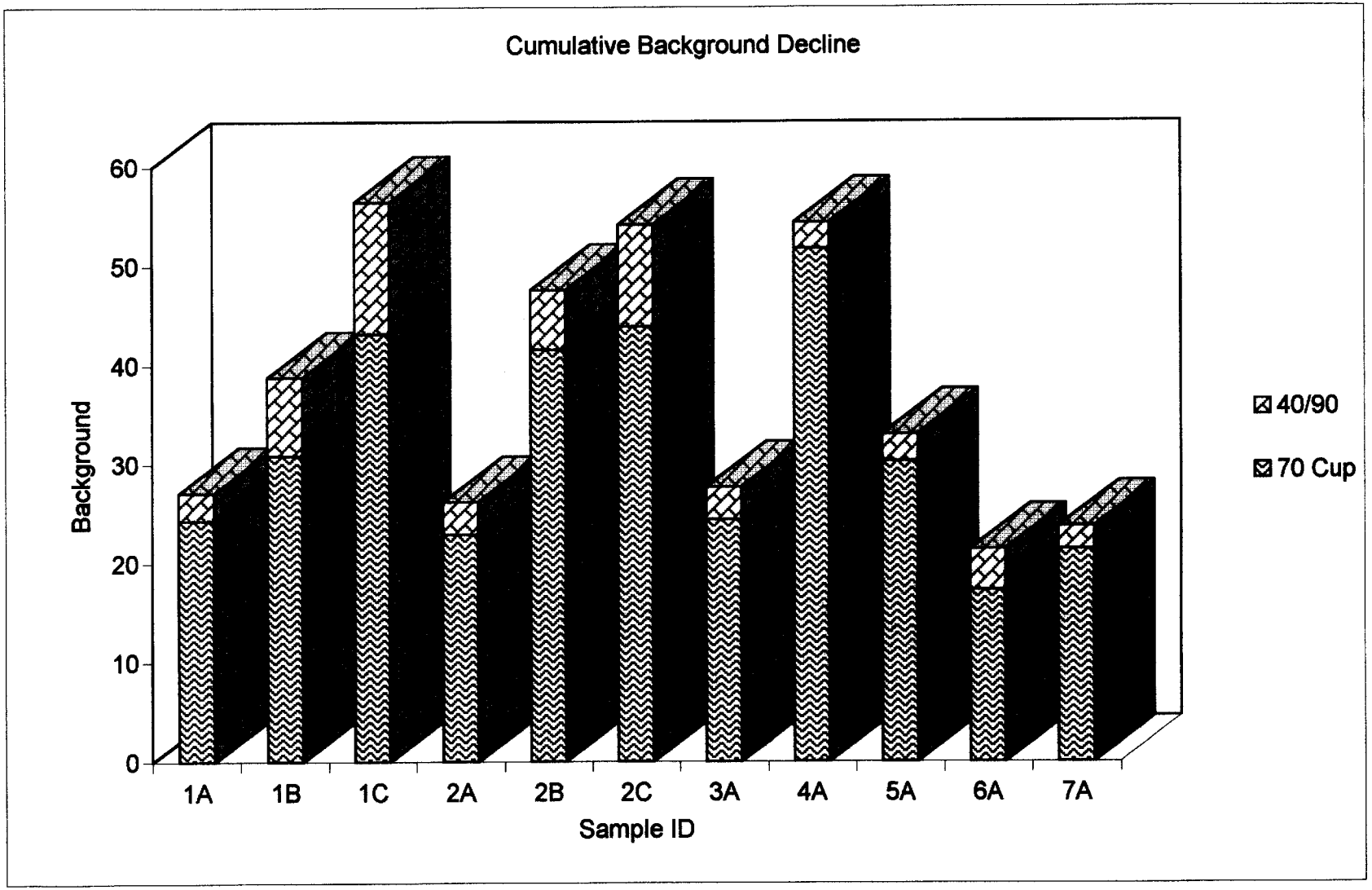
FIG. 8 is a bar graph representation of background decline values of samples subjected to relative humidity and 70° cup humidity challenges.

The present invention is a novel and improved thermally-responsive record material useful for bar coding. The invention comprises a support having provided thereon in substantially contiguous relationship a substantially colorless dye precursor comprising 2-anilino-3-methyl-6-dibutylaminoflouran

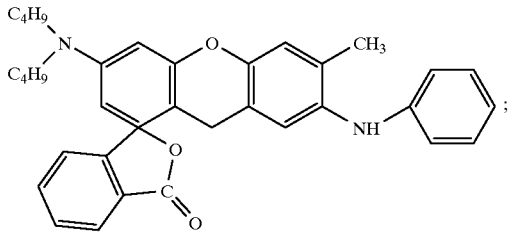

;

a sensitizer selected from the group consisting of 1,2-diphenoxyethane

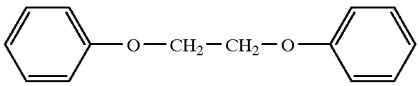

;

and 1,2-(4-methylphenoxy)ethane

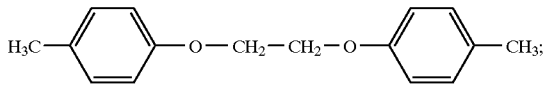

an acidic developer material comprising bis-(3-allyl-4-hydroxyphenyl) sulfone

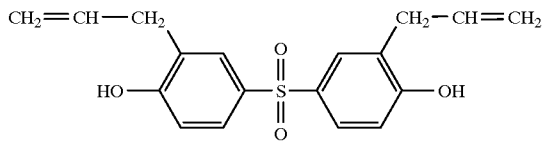

which upon being heated reacts with said dye precursor to develop color; and a binder material.

In addition, other materials can optionally be included in the thermally-responsive record material including fillers, antioxidants, lubricants, waxes and brighteners.

The present invention is also an improved bar code comprising a thermally-responsive record material comprising a support having provided thereon a heat sensitive layer comprising a substantially colorless dye precursor comprising 2-anilino-3-methyl-6-dibutylaminofluoran; a sensitizer selected from the group consisting of 1,2-diphenoxyethane and 1,2-(4-methylphenoxy)ethane; an acidic developer material comprising bis-(3-allyl-4-hydroxyphenyl) sulfone which upon being heated reacts with said dye precursor to develop color. The heat sensitive layer on the support is imaged by selective application of heat in the pattern of a bar code. Bar codes are well known and typically comprise a plurality of uniformly spaced apart parallel vertical lines, often of differing thicknesses forming a row extending from a common horizontal axis. The horizontal axis is generally not shown but is a convenient reference point for descriptive purposes. The spaced apart parallel neutral lines are arranged in a row.

The thermally-responsive record material and bar code of the invention has the unexpected and remarkable properties of being capable of forming a non-reversible high density bar code image upon selective thermal contact and of retaining that bar code image over time when subjected to common external environmental challenges.

The remarkable properties of the combination of the invention yields a thermally-responsive record material unique in that it forms an image displaying high print contrast signal, resistance to bar width growth degradation, a high percentage of successful decoding, and low background discoloration.

The record material according to the invention has a non-reversible image in that it is non-reversible under the action of heat. The coating of the record material of the invention is basically a dewatered solid at ambient temperature.

The color-forming system of the record material of this invention comprises the electron donating dye precursors, also known as chromogenic material, in its substantially colorless state together with an acidic developer material. The color-forming system relies upon melting, softening, or subliming one or more of the components to achieve reactive, color-producing contact with the chromogen. Substantially colorless for purposes of the invention is understood to mean colorless or lightly or faintly colored.

The invention is functional with 2-anilino-3-methyl-6-dibutylaminofluoran, including in the various crystalline or recrystallized forms such as α or β.

The record material includes a substrate or support material which is generally in sheet form. For purposes of this invention, sheets can be referred to as support members and are understood to also mean webs, ribbons, tapes, belts, films, cards and the like. Sheets denote articles having two large surface dimensions and a comparative small thickness dimension. The substrate or support material can be opaque, transparent or translucent and could, itself, be colored or not. The material can be fibrous including, for example, paper and filamentous synthetic materials. It can be a film including, for example, cellophane and synthetic polymeric sheets cast, extruded, or otherwise formed. The invention resides in the color-forming composition coated on the substrate. The kind or type of substrate material is not critical. Neutral sized base paper has been used in thermally-imaged record systems for 25 years and is a preferred substrate.

The components of the heat sensitive coating are in substantially contiguous relationship, substantially homogeneously distributed throughout the coated layer or layers deposited on the substrate. For purposes of this invention the term substantially contiguous is understood to mean that the color-forming components are positioned in sufficient proximity such that upon melting, softening or subliming one or more of the components, a reactive color-forming contact between the components is achieved. As is readily apparent to the person of ordinary skill in this art, these reactive components accordingly can be in the same coated layer or layers, or individual components positioned in separate layers using multiple layers. In other words, one component can be positioned in the first layer, and coreactive or sensitizer components positioned in a subsequent layer or layers. All such arrangements are understood herein as being substantially contiguous.

The acidic developer to dye precursor ratio by weight is preferably maintained at from 1:1 to about 2:1. The sensitizer to dye precursor ratio by weight is preferably maintained at greater than 1:1.

In manufacturing the record material, a coating composition is prepared which includes a fine dispersion of the components of the color-forming system, and binder material, preferably polymeric binder such as polyvinyl alcohol. Surprisingly, the composition of the invention preferably is free of pigments including clays and fillers. Preferably, pigments, if included, are maintained at less than 13% by weight of the heat sensitive coating composition of the invention.

The heat-sensitive coating composition can additionally contain pigments, such as clay, talc, silicon dioxide, aluminum hydroxide, calcined kaolin clay and calcium carbonate, and urea-formaldehyde resin pigments maintained at less than 13% by weight of the heat-sensitive coating. Other optional materials include natural waxes, Carnauba wax, synthetic waxes, lubricants such as zinc stearate; wetting agents; defoamers, other sensitizers and anti-oxidants. The sensitizer typically does not impart any image on its own but as a relatively low melt point solid, acts as a solvent to facilitate reaction between the mark-forming components of the color-forming system. Optionally the thermally-sensitive record material can be top coated with a polymeric coating such as polyvinyl alcohol.

The color-forming system components are substantially insoluble in the dispersion vehicle (preferably water) and are ground to an individual average particle size of less than 10 microns, preferably less than 3 microns. The polymeric binder material is substantially vehicle soluble although latexes are also eligible in some instances. Preferred water soluble binders, which can also be used as topcoats, include polyvinyl alcohol, hydroxy ethylcellulose, methylcellulose, methyl-hydroxypropylcellulose, starch, modified starches, gelatin and the like. Eligible latex materials include polyacrylates, styrene-butadiene-rubber latexes, polyvinylacetates, polystyrene, and the like. The polymeric binder is used to protect the coated materials from brushing and handling forces occasioned by storage and use of thermal sheets. Binder should be present in an amount to afford such protection and in an amount less than will interfere with achieving reactive contact between color-forming reactive materials.

Coating weights can effectively be about 3 to about 9 grams per square meter (gsm) and preferably about 5 to about 6 gsm. The practical amount of color-forming materials is controlled by economic considerations, functional parameters and desired handling characteristics of the coated sheets.

The following examples are given to illustrate some of the features of the present invention and should not be considered as limiting. In these examples all parts or proportions are by weight and all measurements are in the metric system, unless otherwise stated.

In all examples illustrating the present invention a dispersion of a particular system component can be prepared by milling the component in an aqueous solution of the binder until a particle size of less than 10 microns is achieved. The milling was accomplished in an attritor or other suitable milling device. The desired average particle size was less than 3 microns in each dispersion.

The thermally-responsive sheets were made by making separate dispersions of chromogenic material, sensitizer material, and developer material. The dispersions are mixed in the desired ratios and applied to a support with a wire wound rod and dried. Other materials such as fillers, antioxidants, lubricants and waxes can be added if desired. The sheets may be calendered to improve smoothness.

The thermal performance of the sheet can be measured by imaging the sheet on a dynamic thermal tester, such as an Atlantek Thermal Response Tester, Model 200.The thermal testing unit images the sheet with a constant cycle time, and a sequentially increasing dot pulse duration resulting in a series of thermal images of increasing intensity. The thermal images can be measured using a MacBeth RD-922 densitometer. The densitometer is calibrated such that 0.05 indicates pure white and 1.79 a fully saturated black image.

The use of just a MacBeth densitometer alone to measure the properties of thermal recording material has been found not to fully capture all the necessary information needed to ascertain the true suitability of thermal recording material for producing a functional bar code. It is useful for determining background but the necessary information to evaluate a thermal recording material for producing a truly functional bar codes needs to be derived from the following additional tests: PCS (print contrast signal), BWG (bar width growth), % Decode (percentage of the scans which will result in a successful decoding of the information in the bar code), and the background (the relative darkness of the unimaged area). The invention exhibits excellent properties as a thermal recording material for producing functional bar codes. No known direct thermal recording material chemistry has, up to this point, been shown to meet the criteria of superior properties in terms of all the characterizing bar code tests of PCS intensity, BWG, % Decode and whiteness of background.

The LaserChek II scanner and verifier of Symbol Technologies conveniently can measure print contrast signal, change in bar width growth, percent decode and background.

The use of a MacBeth densitometer measurement alone can be insufficient in ascertaining suitability of a thermal recording material for bar code applications. The densitometer measures image density, but in a bar code application, a dense image could nonetheless be deficient. Characters or character edges may be fuzzy or indistinct. Pinholes could exist in otherwise dense solid areas and similar defects all can make an otherwise dense image unsuitable for bar code applications, despite a high MacBeth reading.

The addition of tests such as PCS, BWG and % Decode provides a more accurate screening for suitability for bar code applications.

The following bar code related tests are conveniently measured with LaserChek II scanner and verifier. Standardize LaserChek II scanner and verifier unit to 0.90 PCS ratio.

% Decode is a measure of the average probability that a single scan of a bar code would result in a successful decode or translation. In a well designed bar code system, that probability is desired to approach 100%.

PCS or print contrast signal is a measurement of the contrast or brightness difference between the bars and spaces of a bar code. A threshold PCS value is needed for a bar code to be scannable. PCS=(RL−RD)/RL; where RL is the reflectance of the background and RD is the reflectance of the dark bars.

BWG is the average deviation of bars from nominal widths over the entire symbol. The thickness of the bar is measured from the edge closest to the start character to the trailing edge of the same bar.

In the examples and tables, the above four tests were applied to samples exposed to a series of different environmental challenges including oil, water, alcohol, 40° C. PVC, Wet PVC (WPVC), 40°/90° humidity (40/90) and 70° cup humidity.

Test Methods

Test procedure: Samples are imaged on Hobart 18VP printer. Cut into individual samples with each sample bearing a complete bar code.

Water test: Imaged samples are placed into 100 ml beakers that contain distilled water. Each beaker is able to hold two samples. The bar codes should not contact each other. The bar code should be completely immersed. Retain samples in the water for 24 hours at room temperature. Then, remove from the water and allow to air dry for not less than four hours and not more than 24 hours. Read and record with LaserChek II scanner and bar code verifier. The PCS, BWG, % Decode and background are measured.

70° C. Cup Humidity Test: This method can be used for determining the physical resistance of samples to environmental humidity exposures at 70° C. The following materials are used in conducting this test: Hobart 18 VP printer or equivalent; LaserChek II scanner and verifier; test samples 2 9/16" (CD×11" (MD); 1000 ml beaker; 1000 ml beaker cover; oven maintained at 70° C.

Image bar code on samples using Hobart printer. Adjust voltage to 1.2 watts/dot. Cut strip into individual labels. Each label should have a complete bar code.

Imaged samples are secured inside of a 1000 ml beaker containing 250 ml of water. The labels should not be contacting the water directly. The lid is placed on the beaker and the beaker is placed in the 70° C. oven for 24 hours. The labels are removed from the beaker and allowed to air dry for not less than 1 hour or more than 24 hours. Read image with LaserChek II scanner and verifier.

The PCS, PWG, % Decode and background are measured.

40°C./90% RH: Cut two samples of the paper to be tested to 4 ½" CD×7"MD. Cut an approximate 1" diameter circle from center of sample. Place samples suspended apart in a 40° C.-90% relative humidity chamber. Maintain temperature and humidity at 40° C. (104° F.) dry bulb and 90% RH (100F.) wet bulb. After exactly 48 hours, remove samples, and cool. Record original background and background after exposure. Calculate and record the percent change in background decline using the following formula:

$$\frac{\text{Original Background—Exposed Background}\times 100}{\text{Original Background}}$$

The PCS, BWG, Decode and background are conveniently measured with a LaserChek II scanner and verifier of Symbol Technologies: A MacBeth densitometer can also be used for background measurement.

Wet PVC-Room Temperature. Four imaged labels are immersed in distilled water for five seconds. Immediately wrap the wet label in plastic film as described in the 40° C. PVC test. Place the wrapped labels between two hard, flat surfaces and under a 7 lb. weight. Store at ambient room temperature for 24 hours. Then, unwrap the labels and let them air dry. Read and record with LaserChek II scanner and verifier. The print contrast signal (PCS) bar width growth (BWG), and percent decode (% Decode) is measured with the LaserChek II scanner and verifier of Symbol Technologies.

40° C. PVC Resistance. Imaged samples are covered with at least three layers of Borden PVC film on both sides. Make sure that the film is free of wrinkles and foldovers. Place the wrapped samples between two hard, flat surfaces with 3.5 kg weight on top to ensure good contact between the plastic film and the printed label. Store in 40° C. oven for 24 hours, unwrap the labels and read with LaserChek II scanner and verifier. The print contrast signal (PCS), bar width growth (BWG) and percent decode (% Decode) is measured with the LaserChek II scanner and verifier.

Alcohol Resistance. Imaged samples are placed into 100 ml beakers that contain 20% by weight isopropyl alcohol. Each beaker is able to hold two samples. The bar code samples should not contact each other. The bar codes should be completely immersed. Retain sample in alcohol for two hours at room temperature. Then, remove samples from the alcohol and allow to air dry for 24 hours. Read and record with LaserChek II scanner and verifier. The PCS, BWG and % Decode are measured with the LaserChek II scanner and verifier of Symbol Technologies.

Oil Resistance. Imaged samples are placed on a flat surface and tamped to the surface. Pour Crisco vegetable oil on paper toweling. Coat sample with a thin film of oil with toweling. Distribute oil evenly so that there are no "puddles". Store at room temperature for 24 hours. After 24 hours wipe off excess oil. Read and record with LaserChek II. The PCS, BWG and % Decode measured with the LaserChek II scanner and verifier of Symbol Technologies.

The following examples are given to illustrate some of the features of the present invention and should not be considered as limiting. In these examples all parts or proportions are by weight and all measurements are in the metric system, unless otherwise stated.

EXAMPLE 1A

Ten grams of 2-anilino-3-methyl-6-dibutylaminoflouran were dispersed for 2 hours by means of a media mill together with 14 grams of a 13% aqueous solution of polyvinyl alcohol.

Twenty grams of bis (3-allyl-4-hydroxyphenyl) sulfone were dispersed for 2 hours by means of a media mill together with 24 grams of a 9.5% aqueous solution of polyvinyl alcohol. Further, ten grams of 1,2-diphenoxyethane were dispersed for 2 hours by means of a media mill together with 13 grams of a 11% aqueous solution of polyvinyl alcohol.

The above-mentioned three dispersions were mixed together, to which was successively added a binder consisting of a ratio of styrene-butadiene latex and polyvinyl alcohol. The resulting mixture was thoroughly mixed to prepare the fluid for coating.

The coating fluid was applied to a base paper having a basis weight of 64 g/m$^2$ so that the amount of coating (solid) came to 3 g/m$^2$, after which it was dried and a 3 g/m$^2$ coating of topcoat applied. The second coating was dried and calendered to prepare the direct thermal recording material for imaging.

COMPARATIVE EXAMPLE 1B

A direct thermal recording material was prepared by repeating the procedure of Example 1A, except that the compound 2-anilino-3-methyl-6-dibutylaminoflouran was replaced with 2-anilino-3-methyl-6-(cyclohexyl methyl) aminoflouran.

COMPARATIVE EXAMPLE 1C

A direct thermal recording material was prepared by repeating the procedure of Example 1A, except that the compound 2-anilino-3-methyl-6-dibutylaminoflouran was replaced with 2-anilino-3-methyl-6-diethylaminoflouran.

EXAMPLE 2A

Ten grams of 2-anilino-3-methyl-6-dibutylaminoflouran were dispersed for 2 hours by means of a media mill together with 14 grams of a 13% aqueous solution of polyvinyl alcohol.

Twenty grams of bis (3-allyl-4-hydroxyphenyl)sulfone were dispersed for 2 hours by means of a media mill together with 24 grams of a 9.5% aqueous solution of polyvinyl alcohol. Further, ten grams of 1,2-(4-methylphenoxy)ethane were dispersed for 2 hours by means of a media mill together with 13 grams of a 11% aqueous solution of polyvinyl alcohol.

The above-mentioned three dispersions were mixed together, to which was successively added a binder consisting of a ratio of styrene-butadiene latex and polyvinyl alcohol. The resulting mixture was thoroughly mixed to prepare the fluid for coating.

The coating fluid was applied to a base paper having a basis weight of 64 g/m$^2$ so that the amount of coating (solid) came to 3 g/m$^2$, after which it was dried and calendered to prepare the direct thermal recording material for imaging.

COMPARATIVE EXAMPLE 2B

A direct thermal recording material was prepared by repeating the procedure of Example 1A, except that the compound 2-anilino-3-methyl-6-dibutylaminoflouran was replaced with 2-anilino-3-methyl-6-(cyclohexyl methyl) aminoflouran.

COMPARATIVE EXAMPLE 2C

A direct thermal recording material was prepared by repeating the procedure of Example 1A, except that the compound 2-anilino-3-methyl-6-dibutylaminoflouran was replaced with 2-anilino-3-methyl-6-diethylaminoflouran.

COMPARATIVE EXAMPLE 3A

A direct thermal recording material was prepared by repeating the procedure of Example 1A, except that the compound 1,2-diphenoxyethane was replaced with parabenzyl biphenyl.

COMPARATIVE EXAMPLE 4A

A direct thermal recording material was prepared by repeating the procedure of Example 1A, except that the compound 1,2-diphenoxyethane was replaced with dibenzyl oxalate.

COMPARATIVE EXAMPLE 5A

A direct thermal recording material was prepared by repeating the procedure of Example 1A, except that the compound 1,2-diphenoxyethane was replaced with dimethylbenzyl oxalate.

COMPARATIVE EXAMPLE 6A

A direct thermal recording material was prepared by repeating the procedure of Example 1A, except that the compound 1,2-diphenoxyethane was replaced with 1,2-(3,4-dimethylphenyl)ethane.

COMPARATIVE EXAMPLE 7A

A direct thermal recording material was prepared by repeating the procedure of Example 1A, except that the compound 1,2-diphenoxyethane was replaced with dimethyl terephthalate.

COMPARATIVE EXAMPLE 8

A direct thermal recording material was prepared by repeating the procedure of Example 1A, except that the compound bis (3-allyl-4-hydroxyphenyl) sulfone was replaced with 4-hydroxy, 4'-isopropoxy diphenylsulfone.

COMPARATIVE EXAMPLE 9

A direct thermal recording material was prepared by repeating the procedure of Example 1A, except that the compound bis (3-allyl-4-hydroxyphenyl) sulfone was replaced with 2,2-bis(4-hydroxyphenyl) propane also known as "BPA".

The direct thermal recording materials obtained above were recorded by means of an electronic print heat (manufactured by Hobart, model 18VP), and the PCS, BWG, % Decode was measured by a LaserChek II scanner and verifier, (manufactured by Symbol Technologies). Whiteness of the thermal recording material background was measured before and after exposure to 40° C./90% RH for 24 hours and separately before and after exposure to 70° C./90% RH for 24 hours, using a BNL-2 Opacimeter (manufactured by Technidyne Corporation).

TABLE 1

| Trade Name | Chemical Name |
|---|---|
| N-102T | 2-anilino-3-methyl-6-diethylaminoflouran |
| ODB-2 | 2-anilino-3-methyl-6-dibutylaminoflouran |
| PSD-150 | 2-anilino-3-methyl-6-(cyclohexyl methyl) aminoflouran |
| DPE | diphenoxyethane |
| EGTE | di-(4-methylphenoxy) ethane |
| pBBP | p-benzylbiphenyl |
| DBO | dibenzyl oxalate |

TABLE 1-continued

| Trade Name | Chemical Name |
|---|---|
| HS-3520 | di-(4-methyl) benzyl oxalate |
| Y7 | 1,2-bis (3,4-dimethylphenyl) ethane |
| DMT | Dimethyl terephthalate |
| D8 | 4-hydroxy-4'-isopropoxysulfone |
| BPA | 2,2-bis(4-hydroxyphenyl) propane |
| TGSA | bis (3-allyl-4-hydroxyphenyl) sulfone |

TABLE 2

(No Environmental Challenge)

| Sample ID | Active Coat | Initial PCS | Initial BWG | Initial Background | Initial Decode |
|---|---|---|---|---|---|
| 1A | DPE/ODB-2 | 0.90 | 0.10 | 83.5 | 100.0 |
| 1B | DPE/PSD-150 | 0.89 | −0.50 | 81.3 | 100.0 |
| 1C | DPE/N-102T | 0.88 | 0.00 | 74.2 | 100.0 |
| 2A | EGTE/ODB-2 | 0.92 | 0.20 | 81.4 | 100.0 |
| 2B | EGTE/PSD-150 | 0.90 | −0.50 | 77.3 | 100.0 |
| 2C | EGTE/N-102T | 0.89 | −0.40 | 68.5 | 100.0 |
| 3A | pBBP/ODB-2 | 0.88 | −0.55 | 83.1 | 100.0 |
| 4A | DBO/ODB-2 | 0.91 | 1.21 | 80.7 | 100.0 |
| 5A | HS3520/ODB-2 | 0.84 | −0.80 | 83.6 | 100.0 |
| 6A | Y7/ODB-2 | 0.84 | −0.90 | 84.0 | 100.0 |
| 7A | DMT/ODB-2 | 0.81 | −1.5 | 83.4 | 100.0 |
| 8 | D8/DPE/ODB-2 | 0.81 | 0.48 | 89.3 | 100.0 |
| 9 | BPA/DPE/ODB-2 | 0.83 | 0.66 | 88.3 | 100.0 |

TABLE 3

(Environmental Challenge = 70° Cup Humidity Test)

| Sample ID | Active Coat | PCS | BWG | Background | Decode |
|---|---|---|---|---|---|
| 1A | DPE/ODB-2 | 0.88 | −0.97 | 59.2 | 100.0 |
| 1B | DPE/PSD-150 | 0.89 | −0.50 | 50.4 | 100.0 |
| 1C | DPE/N-102T | 0.88 | −0.56 | 31.0 | 50.0 |
| 2A | EGTE/ODB-2 | 0.91 | −0.54 | 58.5 | 100.0 |
| 2B | EGTE/PSD-150 | 0.90 | −0.52 | 35.7 | 81.0 |
| 2C | EGTE/N-102T | 0.87 | −0.59 | 24.6 | 80.0 |
| 3A | pBBP/ODB-2 | 0.86 | −1.97 | 58.7 | 100.0 |
| 4A | DBO/ODB-2 | 0.90 | −0.66 | 28.9 | 50.0 |
| 5A | HS3520/ODB-2 | 0.84 | −2.38 | 53.3 | 100.0 |
| 6A | Y7/ODB-2 | 0.82 | −2.38 | 66.7 | 100.0 |
| 7A | DMT/ODB-2 | 0.79 | −3.07 | 62.0 | 35.0 |
| 8 | D8/DPE/ODB-2 | 0.84 | −2.5 | 56.1 | 0 |
| 9 | BPA/DPE/ODB-2 | 0.82 | −3.5 | 43.8 | 0 |

TABLE 4

(Environmental Challenge 40° C./90% RH)

| Sample ID | Active Coat | PCS | BWG | Background | Decode |
|---|---|---|---|---|---|
| 1A | DPE/ODB-2 | 0.85 | −1.03 | 80.7 | 100.0 |
| 1B | DPE/PSD-150 | 0.87 | −1.30 | 73.4 | 100.0 |
| 1C | DPE/N-102T | 0.88 | −0.83 | 60.9 | 100.0 |
| 2A | EGTE/ODB-2 | 0.89 | −1.38 | 78.1 | 100.0 |
| 2B | EGTE/PSD-150 | 0.90 | −0.94 | 71.3 | 100.0 |
| 2C | EGTE/N-102T | 0.87 | −0.93 | 58.2 | 100.0 |
| 3A | pBBP/ODB-2 | 0.85 | −1.48 | 79.8 | 100.0 |
| 4A | DBO/ODB-2 | 0.91 | −0.83 | 78.1 | 100.0 |
| 5A | HS3520/ODB-2 | 0.81 | −2.45 | 80.9 | 50.0 |
| 6A | Y7/ODB-2 | 0.81 | −2.28 | 79.9 | 100.0 |
| 7A | DMT/ODB-2 | 0.78 | −2.45 | 81.1 | 100.0 |
| 8 | D8/DPE/ODB-2 | 0.76 | −3.1 | 86.5 | 50 |
| 9 | BPA/DPE/ODB-2 | 0.78 | −3.5 | 81.1 | 0 |

TABLE 5

(Environmental Challenge = Wet PVC at Room Temperature)

| Sample ID | Active Coat | PCS | BWG | Decode |
|---|---|---|---|---|
| 1A | DPE/ODB-2 | 0.87 | −0.82 | 100.0 |
| 1B | DPE/PSD-150 | 0.84 | −1.00 | 100.0 |
| 1C | DPE/N-102T | 0.83 | −0.50 | 100.0 |
| 2A | EGTE/ODB-2 | 0.85 | −0.85 | 100.0 |
| 2B | EGTE/PSD-150 | 0.83 | −0.84 | 100.0 |
| 2C | EGTE/N-102T | 0.82 | −0.92 | 100.0 |
| 3A | pBBP/ODB-2 | 0.81 | −1.00 | 100.0 |
| 4A | DBO/ODB-2 | 0.82 | −0.14 | 100.0 |
| 5A | HS3520/ODB-2 | 0.75 | −1.90 | 65.0 |
| 6A | Y7/ODB-2 | 0.76 | −1.68 | 100.0 |
| 7A | DMT/ODB-2 | 0.73 | −3.18 | 50.0 |
| 8 | D8/DPE/ODB-2 | 0.43 | −3.5 | 0 |
| 9 | BPA/DPE/ODB-2 | 0.13 | −3.5 | 0 |

TABLE 6

(Environmental Challenge = 40° C. PVC Resistance)

| Sample ID | PCS | BWG | Decode |
|---|---|---|---|
| 1A | 0.92 | −0.69 | 100.0 |
| 1B | 0.93 | −0.55 | 100.0 |
| 1C | 0.87 | −0.88 | 100.0 |
| 2A | 0.90 | −1.16 | 100.0 |
| 2B | 0.90 | −2.62 | 100.0 |
| 2C | 0.87 | −1.23 | 100.0 |
| 3A | 0.86 | −3.17 | 50.0 |
| 4A | 0.91 | −1.79 | 100 |
| 5A | 0.82 | −2.93 | 50 |
| 6A | 0.83 | −3.3 | 96 |
| 7A | 0.79 | −3.5 | 0 |
| 8 | 0.7 | −2.01 | 100 |
| 9 | 0.25 | −3.5 | 0 |

TABLE 7

(Environmental Challenge = Alcohol Resistance)

| Sample ID | PCS | Alcohol BWG | Decode |
|---|---|---|---|
| 1A | 0.87 | −0.69 | 100.0 |
| 1B | 0.84 | −1.00 | 100.0 |
| 1C | 0.84 | −1.05 | 100.0 |
| 2A | 0.89 | −1.00 | 100.0 |
| 2B | 0.84 | −0.41 | 100.0 |
| 2C | 0.84 | −0.80 | 100.0 |
| 3A | 0.83 | −2.05 | 100.0 |
| 4A | 0.84 | −1.83 | 100 |
| 5A | 0.76 | −2.56 | 100 |
| 6A | 0.72 | −2.79 | 50 |
| 7A | 0.73 | −3.5 | 0 |
| 8 | 0.27 | −3.05 | 50 |
| 9 | 0.35 | −3.5 | 0 |

TABLE 8

(Environmental Challenge = Water)

| Sample ID | PCS | BWG | Decode |
|---|---|---|---|
| 1A | 0.85 | −0.52 | 100.0 |
| 1B | 0.83 | −1.00 | 100.0 |
| 1C | 0.82 | −0.48 | 100.0 |
| 2A | 0.84 | −1.00 | 100.0 |
| 2B | 0.83 | −1.01 | 100.0 |
| 2C | 0.77 | −1.02 | 100.0 |
| 3A | 0.70 | −3.30 | 50.0 |
| 4A | 0.81 | −0.35 | 100 |

TABLE 8-continued (Environmental Challenge = Water)

| Sample ID | PCS | BWG | Decode |
|---|---|---|---|
| 5A | 0.7 | −1.37 | 31 |
| 6A | 0.78 | −1.66 | 100 |
| 7A | 0.72 | −2.76 | 100 |
| 8 | 0.29 | −2.45 | 100 |
| 9 | 0.85 | −0.31 | 100 |

TABLE 9

(Environmental Challenge = Oil Resistance)

| Sample ID | PCS | BWG | Decode |
|---|---|---|---|
| 1A | 0.90 | −0.3 | 100.0 |
| 1B | 0.92 | −0.43 | 100.0 |
| 1C | 0.90 | −0.07 | 100.0 |
| 2A | 0.94 | −0.56 | 100.0 |
| 2B | 0.93 | −1.01 | 100.0 |
| 2C | 0.88 | 0.24 | 50.0 |
| 3A | 0.90 | −0.52 | 100.0 |
| 4A | 0.91 | 0.18 | 100 |
| 5A | 0.83 | −1.44 | 100 |
| 6A | 0.86 | −3.5 | 0 |
| 7A | 0.85 | −1.66 | 100 |
| 8 | 0.81 | −2.0 | 50 |
| 9 | 0.25 | −3.5 | 0 |

Examples 1A and 2A illustrate the invention. These compositions display a confluence of characteristics desirable in a bar code thermally-sensitive substrate, namely, low background decline, low PCS loss, low BWG loss and low percent decode loss.

Obvious and included variations would clearly include for example, rather than applying the components of the color-forming system in one coating, multiple layers can be applied. For example, a layer with developer can be top coated with a layer containing dye precursor or chromogen. Another workable variation, equally within the scope of the invention would be to apply to a substrate a coating of dye precursor or chromogen over which is top coated a dispersion of developer. Other such structural variations would be clearly evident to the skilled worker in the art all without departing from the spirit and scope of the invention.

We claim:

1. A thermally-responsive record material useful for bar coding comprising a support having provided thereon in substantially contiguous relationship a heat-sensitive coating comprising:

a substantially colorless dye precursor comprising 2-anilino-3-methyl-6-dibutylaminofluoran;

a sensitizer selected from the group consisting of 1,2-diphenoxyethane and 1,2-(4-methylphenoxy)ethane;

an acidic developer material comprising bis-(3-allyl-4-hydroxyphenyl)sulfone which upon being heated reacts with said dye precursor to develop color; and a binder material.

2. The record material according to claim 1 wherein the ratio by weight of acidic developer to dye precursor is from 1:1 to 2:1.

3. The record material according to claim 1 wherein the ratio by weight of sensitizer to dye precursor is greater than 1:1.

4. The record material according to claim 1 wherein the record material includes in addition a pigment at less than 13% by weight of the heat-sensitive coating.

5. A thermally-responsive record material use for bar coding comprising a support having provided thereon in substantially contiguous relationship a heat sensitive coating comprising:

a substantially colorless dye precursor comprising 2-anilino-3-methyl-6-dibutylaminofluoran;

a sensitizer comprising 1,2-diphenoxyethane;

an acidic developer material comprising bis-(3-allyl-4-hydroxyphenyl) sulfone which upon being heated reacts with said dye precursor to develop color; and a binder material.

6. The record material according to claim 5 wherein the ratio by weight of acidic developer to dye precursor is from 1:1 to 2:1.

7. The record material according to claim 5 wherein the ratio by weight of sensitizer to dye precursor is greater than 1:1.

8. The record material according to claim 5 wherein the record material includes in addition a pigment at less than 13% by weight of the heat-sensitive coating.

9. A thermally-responsive record material useful for bar coding comprising a support having provided thereon in substantially contiguous relationship a heat sensitive coating comprising:

a substantially colorless dye precursor comprising 2-anilino-3-methyl-6-dibutylaminofluoran;

a sensitizer comprising 1,2-(4-methylphenoxy)ethane;

an acidic developer material comprising bis-(3-allyl-4-hydroxyphenyl) sulfone which upon being heated reacts with said dye precursor to develop color;

and a binder material.

10. The record material according to claim 9 wherein the ratio by weight of acidic developer to dye precursor is from 1:1 to 2:1.

11. The record material according to claim 9 wherein the ratio by weight of sensitizer to dye precursor is greater than 1:1.

12. The record material according to claim 9 wherein the record material includes in addition a pigment at less than 13% by weight of the heat-sensitive coating.

13. An improved bar code comprising a thermally-responsive record material comprising a support having provided thereon a heat sensitive layer comprising a substantially colorless dye precursor comprising 2-anilino-3-methyl-6-dibutylaminofluoran; a sensitizer selected from the group consisting of 1,2-diphenoxyethane and 1,2-(4-methylphenoxy)ethane; an acidic developer material comprising bis-(3-allyl-4-hydroxyphenyl)sulfone which upon being heated reacts with said dye precursor to develop color; said heat sensitive layer on the support is imaged by selective application of heat in the pattern of a bar code comprising a plurality of spaced apart parallel vertical lines arranged in a row.

14. The bar code according to claim 13 wherein the ratio by weight of acidic developer to dye precursor is from 1:1 to 2:1.

15. The bar code according to claim 13 wherein the ratio by weight of sensitizer to dye precursor is greater than 1:1.

16. The bar code according to claim 13 wherein the thermally-responsive record material in addition includes a pigment at less than 13% by weight of the heat-sensitive layer.

* * * * *